United States Patent [19]

Matsudo et al.

[11] 4,084,991

[45] Apr. 18, 1978

[54] ENAMELED COLD ROLLED SHEET

[75] Inventors: Kazuo Matsudo; Takayoshi Shimomura; Teruo Kurokawa, all of Fukuyama, Japan

[73] Assignee: Nippon Kokan Kabushiki Kaisha, Tokyo, Japan

[21] Appl. No.: 731,840

[22] Filed: Oct. 12, 1976

Related U.S. Application Data

[62] Division of Ser. No. 583,879, Jun. 5, 1975, abandoned.

[30] Foreign Application Priority Data

Jul. 10, 1974 Japan ..... 49-78190

[51] Int. Cl.[2] ..... C22C 38/04

[52] U.S. Cl. ..... 148/31.5; 148/12 C; 148/36

[58] Field of Search ..... 148/31.5, 12 C, 31, 148/36; 29/527.1, 527.2; 427/376 D

[56] References Cited

U.S. PATENT DOCUMENTS

| | | | |
|---|---|---|---|
| 2,065,392 | 12/1936 | Porter et al. | 148/12 C |
| 2,878,151 | 3/1959 | Beall et al. | 148/12 C |
| 3,843,415 | 10/1974 | Leslie | 148/12 C |

*Primary Examiner*—Arthur J. Steiner

*Attorney, Agent, or Firm*—Flynn & Frishauf

[57] ABSTRACT

An enameling steel sheet characterized by a manganese content of 0.50 wt.% or under and the elimination of annealing after the final cold rolling. A satisfactory enamel adhesive property can be obtained by enameling and baking said enameling steel sheet in as-cold-rolled state after only degreasing and drying.

7 Claims, 10 Drawing Figures

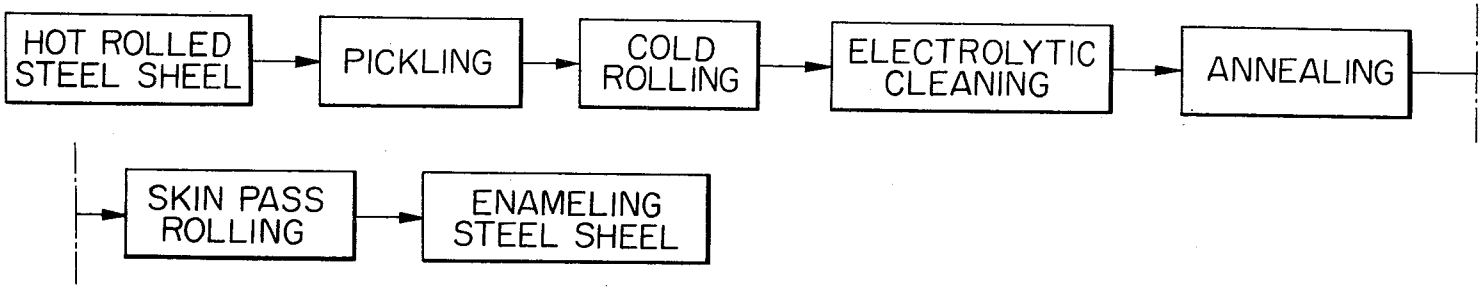
FIG. 1-a
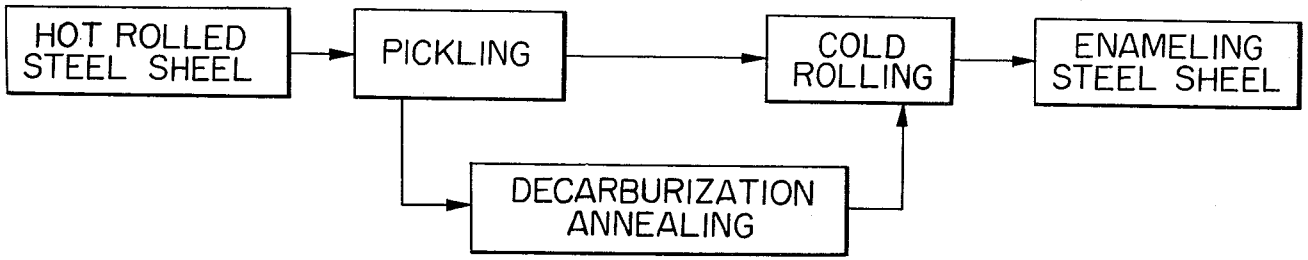
FIG. 1-b-1
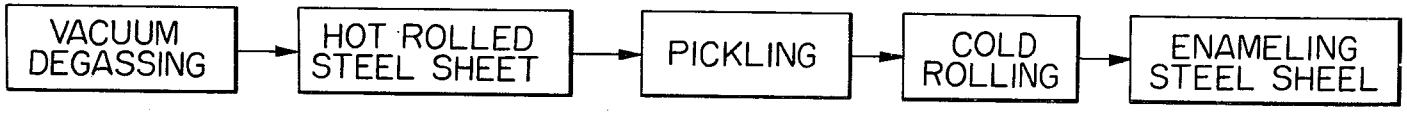
FIG. 1-b-2

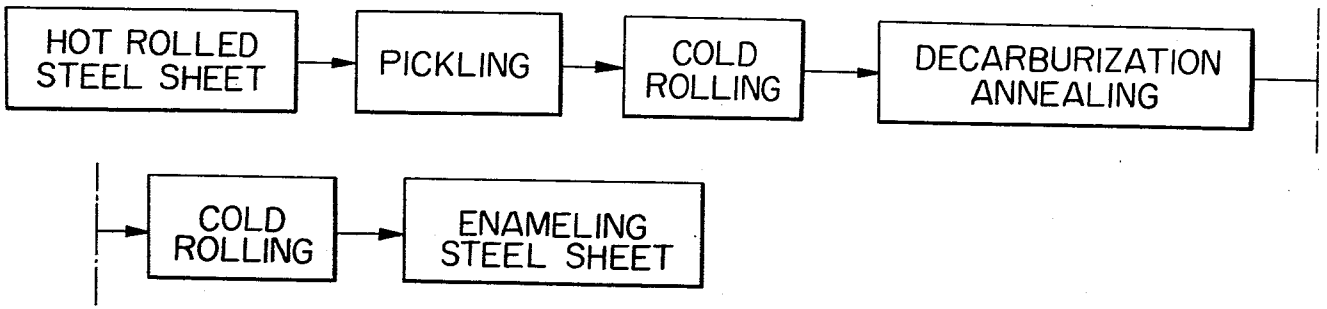
FIG. 1-b-3
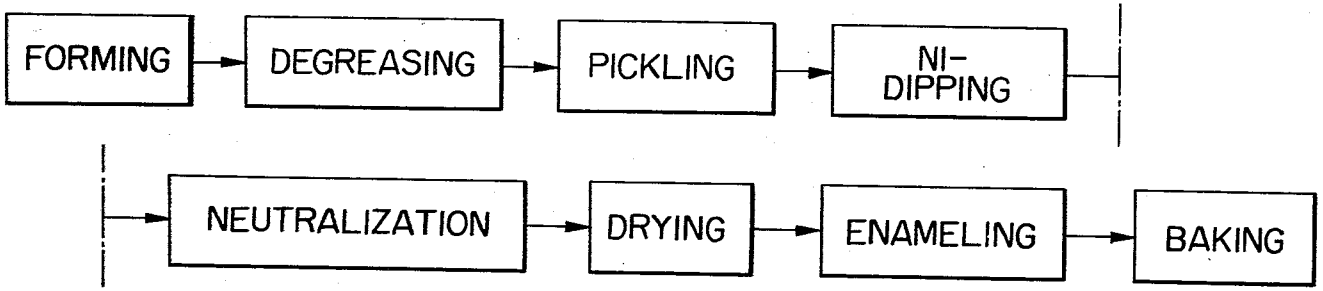
FIG. 2-a
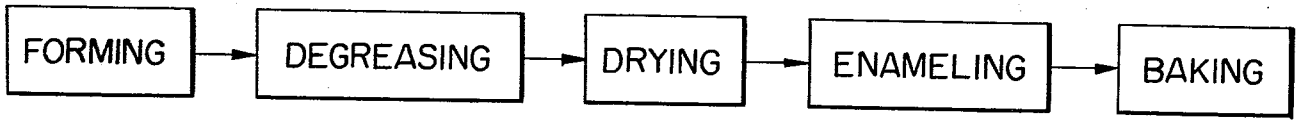
FIG. 2-b

ENAMELED COLD ROLLED SHEET

RELATED APPLICATION

This application is a division of application Ser. No. 583,879, filed June 5, 1975, now abandoned.

FIELD OF THE INVENTION

This invention relates to an enameling steel sheet suitable for enameled products having a relatively low degree of forming, such as enameled panel, enameled blockboard and enameled chimney.

BACKGROUND OF THE INVENTION

Although enameled products such as enameled panel, enameled blackboard and enameled chimney have a relatively low degree of forming, these enameled products have so far been produced, in a process as shown in FIG. 2*a*, in the same way as in enameled products having a higher degree of forming, using an enameling cold rolled steel sheet produced in the process shown in FIG. 1*a*. More specifically, in the production process of enameling cold rolled steel sheet, as shown in FIG. 1*a*, a hot rolled steel sheet is sequentially subjected to treatments such as pickling, cold rolling, electrolytic cleaning, annealing and skin pass rolling. Next, in the production process of enameled products, as shown in FIG. 2*a*, said enameling cold rolled steel sheet produced in the above mentioned process is subjected to treatments such as forming, degreasing, pickling, Ni-dipping, neutralization, drying, enameling and baking for producing the abovementioned enameled products.

However, the production method of the enameled products mentioned above not only requires subtantial cost because it comprises a plurality of production processes, but also fails to decrease enameling defects for such time and labor required. Besides, since acids are used in large quantities, the method has a disadvantage in that there is a possibility of causing environmental problems in relation to the disposal of waste acids after use.

For example, an unbaked enameling steel sheet (Japanese Patent Publication No. 29,289/73) has been proposed as a method that solves these problems. However, this method requires the steel sheet manufacturer to install facilities for enameling and drying. Further, it is expensive also in that a resin, which is unnecessary for the enameled products after baking, is used. Besides, it has a disadvantage in that said resin will be cracked on baking to generate black smoke, thus causing air pollution.

SUMMARY OF THE INVENTION

Therefore, one object of this invention is to provide an enameling steel sheet suitable for enameled products having a relatively low degree of forming.

A principal object of this invention is to provide an enameling steel sheet that can be enameled and baked in as-cold-rolled state after only degreasing and drying without being subjected to processes such as annealing and skin pass rolling.

Yet another object of this invention is to provide an enameling steel sheet capable of eliminating pretreating processes such as pickling and Ni-dipping that have been essential for obtaining a good enamel adhesive property.

The enameling steel sheet of this invention is characterized by a manganese content of 0.50 wt.% or under and the elimination of annealing after the final cold rolling. Said enameling steel sheet can be enameled and baked in as-cold-rolled state after only degreasing and drying.

BRIEF DESCRIPTION OF THE DRAWINGS

Of the drawings:

FIG. 1*a* is a schematic drawing which shows an outline of the conventional production process of enameling cold rolled steel sheet, and FIGS. 1*b*-1 to 1*b*-3 are schematic drawings which shown an outline of the production process of the enameling steel sheet of this invention;

FIG. 2*a* is a schematic drawing of the conventional enameling process, and FIG. 2*b* is a schematic drawing of the enameling process, wherein the enameling steel sheet of this invention is used;

FIG. 3 is a graph which shows respective P.E.I. adherence indices (%) for the conventional enameling cold rolled steel sheet and the enameling steel sheet of this invention.

DETAILED DESCRIPTION OF PREFERRED EMBODIMENTS

Figure 3:
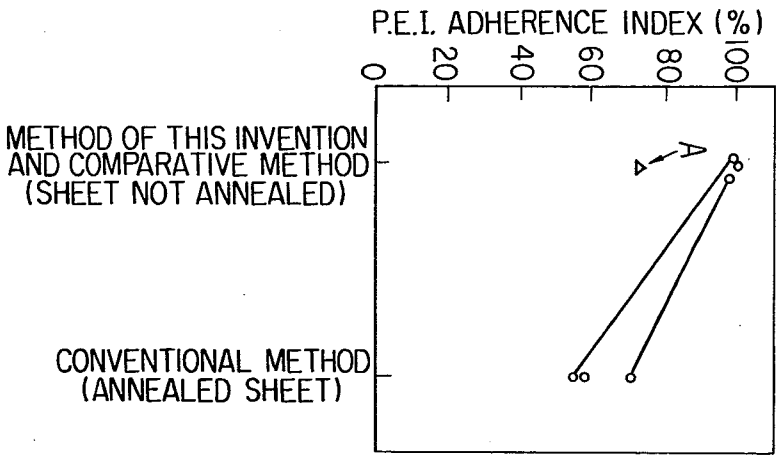

The enameling steel sheet of this invention is characterized by a manganese content of 0.50 wt.% or under and the elimination of annealing after the final cold rolling, and can be enameled and baked in as-cold-rolled state.

In this invention, the manganese content of the steel sheet is limited to 0.50 wt.% or under on the basis of knowledge and findings that the manganese content of the steel sheet surface on enameling is greatly related to factors controlling the enamel adhesive property and that a good enamel adhesive property can never be obtained if the manganese content of the steel sheet exceeds 0.50 wt.%.

In this invention, furthermore, the state of the steel sheet on enameling is limited to the as-cold-rolled state because the steel sheet surface in as-cold-rolled state is not only clean but also highly activated, thus producing on baking a strong bonding power between the steel sheet surface and enamel that can never be obtained in cases where the steel sheet in any other state (i.e., the steel sheet in as-hot-rolled state or the steel sheet cold rolled after hot rolling and then annealed) is enameled. More specifically, the steel sheet surface is subjected, in addition to compression, to serious shearing deformation due to the friction between the work roll and the steel sheet surface, and thus, the old surface of said steel sheet is mechanically scraped off or a new surface is formed. Therefore, the steel sheet surface is very clean after cold rolling. Furthermore, since atomic voids and dislocation increase in the steel sheet due to the plastic deformation caused in cold rolling and slip steps are also formed, the surface of the steel sheet is in a very activated (very reactive, in other words) state. On the contrary, the steel sheets in other states, such as a steel sheet in as-hot-rolled state, have disadvantages in that the surfaces of these steel sheets are not clean because these surfaces are thickly covered with scale and that a predetermined uniform thickness can not be obtained. Besides, in the steel sheet cold rolled after hot rolling and then annealed such as the conventional enameling cold rolled steel sheet, a satisfactory enamel adhesive property can not be obtained unless it is subjected to pretreatments such as pickling and Ni-dipping prior to enameling.

In the enameling steel sheet of this invention, the only thing to be noted in composition is the manganese content and there is no particular restrictions for the other constituents. The "bubbling", one of the defects in enameled products is generally believed to be caused by the reaction between carbon in the steel sheet and oxygen in enamel or in the baking atmosphere. This is especially problematic in once-enameled-products. It is recommended that the carbon content of the steel sheet is reduced to less than 0.01 wt.% to eliminate said bubbling. FIGS. 1*b*-1 to 1*b*-3 show an outline of the production process of the enameling steel sheet of this invention. Even in this invention, an enameling steel sheet containing less than 0.01 wt.% carbon can be produced, e.g., by vacuum-degassing molten steel in any known manner as shown in FIG. 1*b*-2, or by cold rolling the hot rolled steel sheet after decarburization annealing, as shown in FIG. 1*b*-1, or by cold rolling the hot rolled steel sheet before and after decarburization annealing, as shown in FIG. 1*b*-3. However, the carbon content of the enameling steel sheet of this invention is not limited to less than 0.01 wt.%. Selection should be made, with due regards to the properties to be possessed by the enameled product, as to whether or not the decarburization annealing shown in FIG. 1*b*-1 is to be omitted, or as to which of the steel sheet manufacturing processes shown in FIGS. 1*b*-1 to 1*b*-3 is to be adopted.

A cold reduction ratio of the enameling steel sheet of this invention just before enameling should only be more than 30%, which is the usual cold reduction ratio, and there is no particular limitation.

FIG. 3 shows P.E.I. test results of the enamel adhesive property of enameled steel sheets. Tested enameled steel sheets were obtained by sampling steel sheets in the stage where a hot rolled steel sheet with a manganese content of 0.50 wt.% or under was still in as-cold-rolled state (i.e., within the scope of this invention), and in the stage where said steel sheet was annealed (i.e., outside the scope of this invention), respectively, and then by enameling and baking these samples after degreasing. In FIG. 3, A shows a result of enameling under the same condition as mentioned above, for the steel sheet with a manganese content of 0.53 wt.% (i.e., outside the scope of this invention) in as-cold-rolled state.

As is apparent from FIG. 3, the enamel adhesive property of the conventional enameling cold rolled steel sheet annealed is far inferior to that of the enameling steel sheets not annealed and in as-cold-rolled state according to this invention, in cases where these steel sheets are both enameled without pickling. At a higher manganese content as 0.53 wt.%, furthermore, even the enameling steel sheets not annealed and in as-cold-rolled state are not satisfactory in terms of the enamel adhesive property being almost at the same level as that of cold rolled steel sheets subjected to annealing.

As mentioned above, there is a distinguished difference in the enamel adhesive property between the conventional cold rolled and annealed steel sheet and the steel sheet in as-cold-rolled state without annealing of this invention. This difference is caused partly because manganese diffuses toward the steel sheet surface and the steel sheet surface with an abnormally higher manganese content thus produced impedes the adhesion of enamel in contact therewith.

Figure 4A:
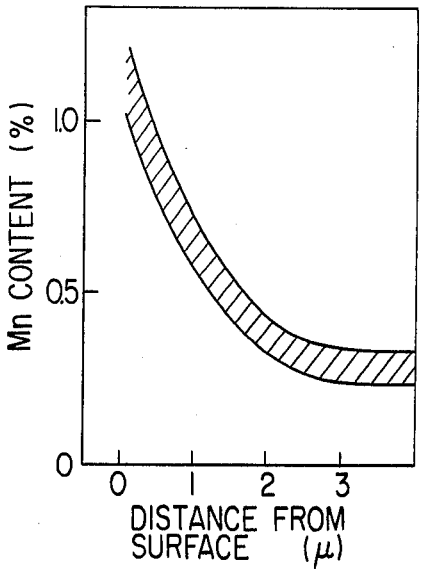
FIG. 4*a* is a graph which shows the manganese distribution in terms of the distance from the surface of the conventional enameling cold rolled steel sheet.
Figure 4B:
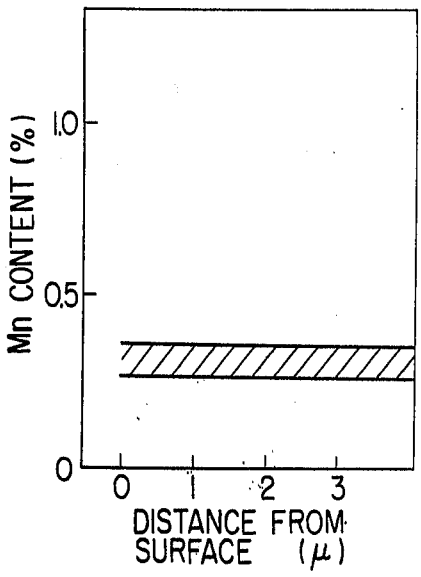
FIG. 4*b* is a graph which shows the manganese distribution in terms of the distance from the surface of the enameling steel sheet of this invention.

FIG. 4 shows the distribution of manganese content in the thickness direction in the steel sheet before and after annealing. Tested steel sheets were obtained from a steel ingot with a manganese content of 0.25–0.30 wt.% through the steps comprising hot rolling — pickling if necessary — cold rolling — annealing. In the steel sheet in as-cold-rolled state before annealing, as shown in FIG. 4*b*, the manganese content is almost constant in the thickness direction. On the contrary, in the steel sheet after annealing, as shown in FIG. 4*a*, the manganese concentration region having a manganese content several times as high as the average manganese content of said steel sheet is found within the distance of 4–5$\mu$ from the surface of said steel sheet. Even the conventional enameling cold rolled steel sheet annealed can be given a good enamel adhesive property if it is subjected to pickling with a satisfactory pickling loss before enameling, not only by reason that the steel sheet surface is activated by pickling but also by reason that said manganese concentration region is chemically eliminated. Even a steel sheet not annealed and in as-cold-rolled state can not be given a good enamel adhesive property if the manganese content exceeds 0.50 wt.%. This is considered attributable to the fact that even if the steel sheet surface is in activated and cleaned state by cold rolling, a manganese content in the surface region of the steel sheet exceeding 0.50 wt.% impedes good adhesion between enamel and the steel sheet surface.

When a steel sheet not annealed and in as-cold-rolled state according to this invention is enameled and baked, an improved enamel adhesive property can be obtained because the activated and cleaned steel sheet surface formed by cold rolling is baked in contact with enamel. Accordingly, the enameling steel sheet of this invention requires no activation and cleaning by pickling of its surface as is required in the conventional enameling cold rolled steel sheet. Besides, the enameling steel sheet according to this invention has a reactive surface because it is in as-cold-rolled state, thus producing oxide films having a good effect on the enamel adhesive property in large quantities at the beginning of enamel baking.

Figure 5:
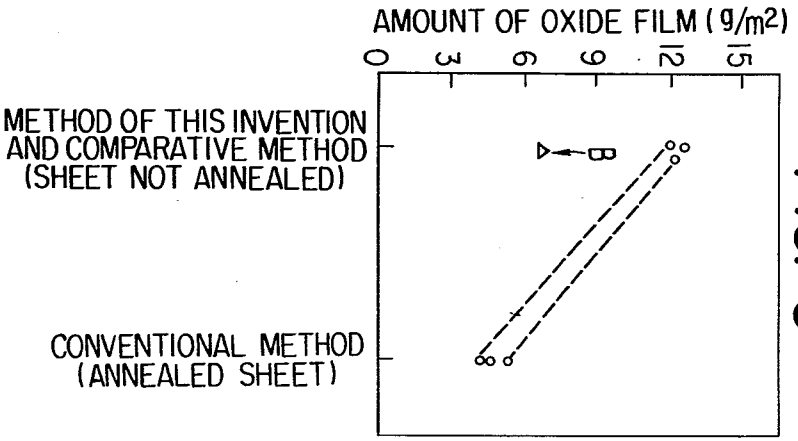
FIG. 5 is a graph which shows the amount of oxide film formed at the beginning of enamel baking (at 850° C), on the conventional enameling cold rolled steel sheet and the enameling steel sheet of this invention, respectively.

FIG. 5 shows the amount of oxide film formed at the beginning of enamel baking (at 850° C) on a conventional enameling cold rolled steel sheet and on an enameling steel sheet of this invention. In FIG. 5, B indicates the amount of oxide film formed at the beginning of enamel baking on a steel sheet in as-cold-rolled state and with a manganese content of 0.53 wt.%. As is apparent from FIG. 5, said amount of oxide film on the enameling steel sheet of this invention is far greater than that on the conventional enameling cold rolled steel sheet. It is also shown that said amount of oxide film is considerably affected by the manganese content of the steel sheet.

When a hot rolled steel sheet is subjected to decarburization annealing after cold rolling, as shown in FIG. 1b-3, the manganese distribution in the steel sheet in the thickness direction after annealing is as shown in FIG.

4a. However, when said steel sheet is then cold rolled again, the very thin surface manganese concentration region of said steel sheet is mechanically scraped off by cold rolling or is dispersed out due to the abrupt increase in surface area by cold rolling. In fact, the manganese distribution in the thickness direction in the steel sheet produced by cold rolling again after decarburization annealing according to the production process as shown in FIG. 1b-3, is as shown in FIG. 4b. Further, the steel sheet surface contaminated and passivated in said decarburization annealing stage is activated and cleaned again by said cold rolling.

The enameling steel sheet of this invention is described below in more detail with reference to some embodiments.

EXAMPLE 1

An enameling steel sheet of this invention was obtained by cold rolling, after pickling, a hot rolled steel sheet having a thickness of 2.3mm and containing 0.047 wt.% carbon, 0.29 wt.% manganese, other unavoidable impuritites and the remainder iron, to 0.5mm. Next, an enameled steel sheet was obtained by applying a commercial enamel to and baking said steel sheet after alkali degreasing. Said enameled steel sheet thus obtained showed a good enamel adhesive property with a P.E.I. adherence index of 100%. Other enamel properties such as fish-scale resistance were also satisfactory. The enameled steel sheet obtained by enameling, under the same condition as mentioned above, a steel sheet outside the scope of this invention, produced from said enameling steel sheet by annealing for about 5 hours at about 700%C, had a P.E.I. adherence index of 55%.

EXAMPLE 2

An enameling steel sheet of this invention was produced by cold rolling, after pickling, a hot rolled steel sheet having a thickness of 2.3mm and containing 0.053 wt.% carbon, 0.32 wt.% manganese, other unavoidable impurities and the remainder iron, to 0.35mm. Next, an enameled blackboard was obtained by applying enamel to and baking said steel sheet after alkali degreasing. Said blackboard thus obtained showed a good enamel adhesive property with a P.E.I. adherence index of 100% and was able to be used as a blackboard without any trouble.

EXAMPLE 3

An enameling steel sheet of this invention was produced by decarburization annealing, after pickling, a hot rolled steel sheet having a thickness of 2.3mm and containing 0.049 wt.% carbon, 0.32 wt.% manganese, other unavoidable impurities and the remainder iron in a humid hydrogen atmosphere and then by cold rolling said steel sheet to 0.35mm. Carbon content of said steel sheet was 0.003 wt.%. Then, an enameled steel sheet as obtained by applying a commercial enamel to and baking said steel sheet after alkali degreasing. Said enameled steel sheet thus obtained showed a good enamel adhesive property and also had a good sagging resistance.

As amplified above, since production processes such as annealing and skin pass rolling are omitted for the enameling steel sheet of this invention, the steel sheet of this invention can be produced at a lower cost than the conventional enameling cold rolled steel sheet for forming (i.e., annealed steel sheet). In conventional enameling cold rolled steel sheet for forming, pickling for activation, Ni-dipping and other treatments are essential as pretreatments on enameling to obtain a good enamel adhesive property. According to the enameling steel sheet of this invention, on the contrary, only degreasing and drying are required as pretreatment for enameling, and other treatments such as pickling for activation and Ni-dipping mentioned above can be omitted. Accordingly, defects generated in enameled products due to pickling such as blisters can be eliminated, pollution sources based on the pickling process can be removed and the work environment can be improved. Further, the production cost can be lowered by the omission of processes, thus producing an industrially useful effect.

What is claimed is:

1. An enameled cold rolled steel sheet, comprising:
   (i) a ferrous enameling sheet and characterized by substantially constant manganese content of up to 0.50 weight percent to a depth of about 5 $\mu$ from the surface thereof, said sheet being produced by cold rolling a steel sheet having a manganese content of up to 0.50 weight percent to cold reduction ratio of more than 30 percent, and
   (ii) an enamel coating on the surface of said ferrous enameling sheet, said enamel coating having been applied immediately after cold rolling without an intermediate anneal.

2. The enameled cold rolled steel sheet of claim 1, wherein said cold rolled steel sheet is formed from a hot rolled steel sheet which is pickled and is then subjected to said cold rolling.

3. The enameled cold rolled steel sheet of claim 1, wherein said cold rolled steel sheet is formed from a hot rolled steel sheet which is pickled, decarburization annealed and then so cold rolled.

4. The enameled cold rolled steel sheet of claim 1, wherein said cold rolled steel sheet is formed from a hot rolled steel sheet produced by vacuum degassing in molten state, said hot rolled steel sheet is pickled and is then so cold rolled.

5. The enameled cold rolled steel sheet of claim 1, wherein said cold rolled steel sheet is formed from a hot rolled steel sheet which is pickled, cold rolled, decarburization annealed and is then so cold rolled.

6. The enameled cold rolled steel sheet of claim 1, wherein said manganese content is from 0.29 to 0.32 percent by weight.

7. The enameled cold rolled steel sheet of claim 1, wherein said manganese content is from 0.29 to 0.32 percent by weight, and the carbon content of said steel sheet is from 0.003 to 0.053 percent by weight.

* * * * *

UNITED STATES PATENT AND TRADEMARK OFFICE

CERTIFICATE OF CORRECTION

PATENT NO. : 4,084,991

DATED : April 18, 1978

INVENTOR(S) : KAZUO MATSUDO et al

It is certified that error appears in the above-identified patent and that said Letters Patent are hereby corrected as shown below:

Column 1, line 12: replace "blockboard" with ---blackboard---.

Column 2, line 11: replace "shown" with ---show---.

Column 5, line 57: replace "as" with ---was---.

Column 6, line 25 (Claim 1): after "sheet", delete "and"

Column 6, line 30 (Claim 1): before "cold", insert ---a---.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*